US008766520B2

(12) United States Patent
Boehler et al.

(10) Patent No.: US 8,766,520 B2
(45) Date of Patent: Jul. 1, 2014

(54) SPARK PLUG WITH GROUND ELECTRODE PLATEAU AND METHOD OF MAKING THE SAME

(71) Applicant: Fram Group IP LLC, Lake Forest, IL (US)

(72) Inventors: Jeffrey T. Boehler, Holland, OH (US); Matthew B. Below, Findlay, OH (US); Jerry Williams Reeves, Jr., Toledo, OH (US); Ovidio Bocanegra, Simpsonville, SC (US); Jayme R. Eastman, Westerville, OH (US); Timothy M. Frech, Columbus, OH (US)

(73) Assignee: Fram Group IP LLC, Lake Forest, IL (US)

( * ) Notice: Subject to any disclaimer, the term of this patent is extended or adjusted under 35 U.S.C. 154(b) by 0 days.

(21) Appl. No.: 13/784,309

(22) Filed: Mar. 4, 2013

(65) Prior Publication Data

US 2013/0234580 A1 Sep. 12, 2013

Related U.S. Application Data

(60) Provisional application No. 61/607,030, filed on Mar. 6, 2012.

(51) Int. Cl.
*H01T 13/20* (2006.01)
*H01T 21/02* (2006.01)

(52) U.S. Cl.
USPC ..... 313/141; 313/143; 313/144

(58) Field of Classification Search
CPC ..... H01T 13/36; H01T 13/39; H01T 21/02
USPC ..... 313/141, 143–145, 118–119; 123/169 R, 169 EL, 32, 41, 310
See application file for complete search history.

(56) References Cited

U.S. PATENT DOCUMENTS

2001/0030495 A1 10/2001 Kanao et al.
2007/0290592 A1 12/2007 Lykowski
2007/0290593 A1 12/2007 Kowalski
2009/0127996 A1 5/2009 Passman et al.

OTHER PUBLICATIONS

Int'l Search Report and Written Opinion of PCT/US2013/028889 dated May 2, 2013.

*Primary Examiner* — Tracie Y Green
(74) *Attorney, Agent, or Firm* — Erin J. Fox; Barnes & Thornburg LLP

(57) ABSTRACT

A ground electrode is provided having a ground electrode body, the ground electrode body having an anchored end and a non-anchored end opposite the anchored end. The ground electrode includes a plateau extending from a surface of the ground electrode body adjacent the non-anchored end. In illustrative embodiments, the plateau is formed by removing a portion of the ground electrode body near the non-anchored end. The plateau is configured to be exposed around its periphery. A noble metal tip is fixably attached to the plateau.

19 Claims, 5 Drawing Sheets

SPARK PLUG WITH GROUND ELECTRODE PLATEAU AND METHOD OF MAKING THE SAME

CROSS-REFERENCE

This application claims the benefit of U.S. Provisional Patent Application No. 61/607,030, filed Mar. 6, 2012 and entitled "Spark Plug with Ground Electrode Plateau," the entire disclosure of which is incorporated herein.

BACKGROUND

This application relates generally to spark plugs for internal combustion engines and, more particularly, to the construction of ground electrodes for such spark plugs. More particularly, the present invention relates to attachment of a noble metal tip to such a ground electrode.

Conventional spark plugs for internal combustion engines generally include a center electrode and a ground electrode. Traditionally, the center electrode may be of a cylindrical shape and the ground electrode may be of a columnar shape having a substantially rectangular cross section. The center electrode and ground electrode define a spark or discharge gap through which a spark extends when the spark plug is firing as intended. Additionally, a noble metal tip may be commonly located at an end of one or both of the electrodes facing the spark gap. Traditional spark plug construction commonly includes attaching these noble metal tips directly to the surface of the electrode, usually on a flat surface near the end or tip of the electrode.

When a noble metal tip is welded to a flat surface with a laser beam, the laser beam melts the base material of the electrode body, but not that of the noble metal tip, thereby creating a connection resembling a braze. Traditionally, the laser welding process securers the noble metal tip to the center electrode and can also be utilized in such a fashion to minimize or avoid cracks or disruptions in the weld between the noble metal tip and the center electrode. By focusing the laser beam on the center electrode body rather than the noble metal tip, the generally cylindrical shape of the center electrode makes it possible for the melted material of the ground electrode body to flow around the noble metal tip in a sufficient manner to form a secure connection without cracks. The shape of the ground electrode, however, does not facilitate a similar free flow of the melted electrode body material, and therefore the resultant braze created between the noble metal tip and the ground electrode is more prone to cracking and less stable than the braze of the center electrode and its noble metal tip.

Accordingly, while existing spark plug electrode welding techniques are suitable for their intended purposes, the need for improvement remains, particularly in providing a ground electrode that allows for the free flow of melted material to form a robust connection with minimal cracking.

SUMMARY

In accordance with an illustrative embodiment, a ground electrode includes a ground electrode body, the ground electrode body including an anchored end and a non-anchored end opposite the anchored end. The ground electrode includes a plateau extending from a surface of the ground electrode body adjacent the non-anchored end. The plateau is exposed around its periphery. A noble metal tip is fixably attached to the plateau.

In accordance with a further illustrative embodiment, a spark plug for an internal combustion engine is provided including an elongated center electrode and an insulator substantially surrounding the center electrode. An outer shell surrounds the insulator. A ground electrode body has an anchored end attached to the outer shell and a non-anchored end extending adjacent the center electrode. The ground electrode body includes a first portion having a first thickness and a second portion having a second thickness. The first portion is thicker than the second portion. A plateau extends from the ground electrode body and a noble metal tip is fixed to the plateau.

In accordance with yet another illustrative embodiment, a method of forming a ground electrode is provided including removing a portion of a ground electrode body near a first end to create a plateau exposed about its periphery. A noble metal tip is then fixed to the plateau.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
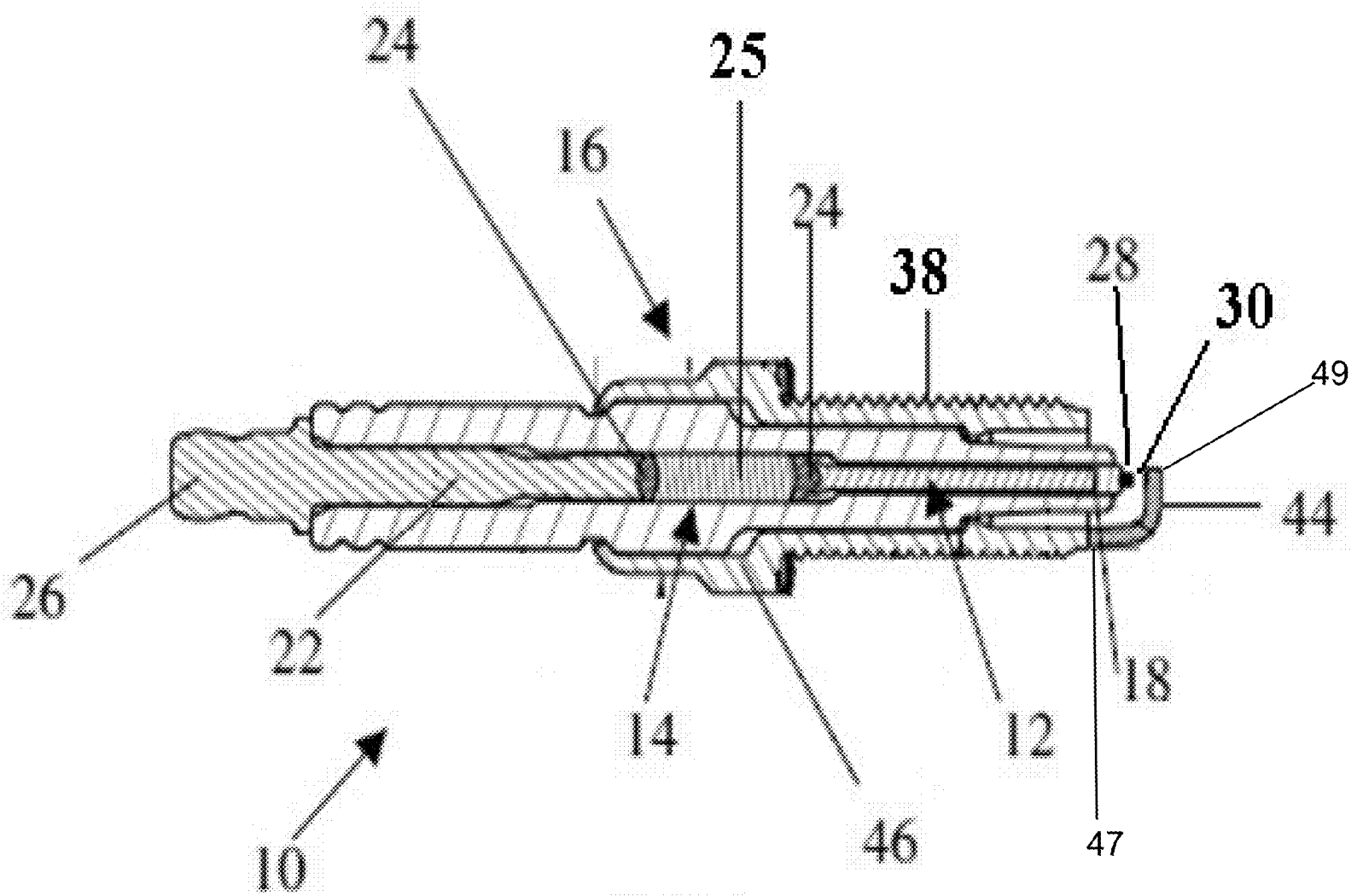
FIG. 1 is a cross-sectional view of a spark plug, and showing a ground electrode coupled to the spark plug extending in an L-shaped manner from the spark plug.

An illustrative spark plug 10 in which the principles of the present disclosure may be implemented includes a center electrode 12, an insulator 14 surrounding the center electrode 12, and a tubular metal shell 16 surrounding the insulator 14. The center electrode 12 extends through the insulator 14 at a first end of the spark plug 10 and a ground electrode 44 extends from the tubular metal shell 16 near the first end of the spark plug 10. In illustrative embodiments, the center electrode 12 may be of a cylindrical shape and the ground electrode 44 may be of a columnar shape, having a substantially rectangular cross section. A spark gap 30 is formed between the center electrode 12 and the ground electrode 44. In illustrative embodiments, a noble metal tip 28 may be mounted on the center electrode 12, the ground electrode 44, or both electrodes 12 and 44. The ground electrode 44 includes a non-anchored end 49 and a substantially cylindrical plateau 48 that is adjacent the non-anchored end 49. The plateau 48 includes an exposed outer periphery 42 conducive to allowing the noble metal tip 28 to be attached to the plateau 48, similar to a periphery of the center electrode 12 when a noble metal tip 28 is attached thereto. In illustrative embodiments, the non-anchored end 49 of the ground electrode 44 is of a thickness T2 that is less thick than a thickness T1 of an anchored end 47 of the ground electrode. The plateau 48 may extend away from the ground electrode 44 past a surface 51 of the ground electrode 44, the surface 51 defining the thickness T2 of the non-anchored end 49.

FIGS. 1-5 illustrate an overall structure of exemplary embodiments of the present invention. The spark plug 10 is illustrated and designed for use in internal combustion engines. When installed, the spark plug 10 protrudes into a combustion chamber (not shown) of the engine through a threaded bore (not shown) provided in an engine head. Spark plug 10 includes the cylindrical center electrode 12 extending along the axial length of the spark plug, the ceramic or similarly comprised insulator 14 that concentrically surrounds the center electrode 12, and the outer metal shell 16 that concentrically surrounds the insulator 14. The ground electrode 44 coupled to the metal shell 16 is configured to extend into the combustion chamber and creates the spark gap 30 between itself and the center electrode 12.

In an illustrative embodiment, one end of the center electrode 12 is electrically connected to a terminal stud 22 through an electrically conductive glass seal 24. In alternate embodiments, an additional resistor element 25 may be attached to the glass seal 24. As is known in the related arts, the terminal stud 22 may be comprised of steel or a steel-based alloy material with a nickel plated finish. The terminal stud 22 further comprises a terminal nut 26 that protrudes from the insulator 14 and attaches to an ignition cable (not shown) that supplies electrical current to the spark plug when connected. Attached at the opposite end of the center electrode 12 is the noble metal tip 28 made of materials such as gold, palladium, iridium, platinum, or some alloy thereof in any suitable form for enabling proper spark plug functioning. For example, a noble metal tip 28 consisting of a finewire may be added to the end of the center electrode 12 to improve wear resistance and maintain the sparking gap 30.

FIG. 1 illustrates the insulator 14 has an elongated, substantially cylindrical body with multiple sections of varying diameters. The outer shell 16 comprises an integral threaded portion 38 for engagement with an engine as well as a hex nut (not shown) for tightening the spark plug 10 with a wrench when it is engaged in an engine. As illustrated in FIG. 1, the ground electrode 44 extends from the threaded portion 38 of the outer shell 16 to define the spark gap 30 between itself and the center electrode 12. The ground electrode 44 is electrically connected with the threaded portion 38 of the outer shell 16 to form an electrical ground when the spark plug 10 is mounted in the engine cylinder. Though the ground electrode 44 in FIG. 1 is depicted in a bent configuration, it may be appreciated that ground electrodes 44 of varying shapes and sizes may be used. For instance, ground electrodes 44 of an L-shape, straight, or bent configuration may be substituted, depending upon the intended application for the spark plug 10.

Figure 2:
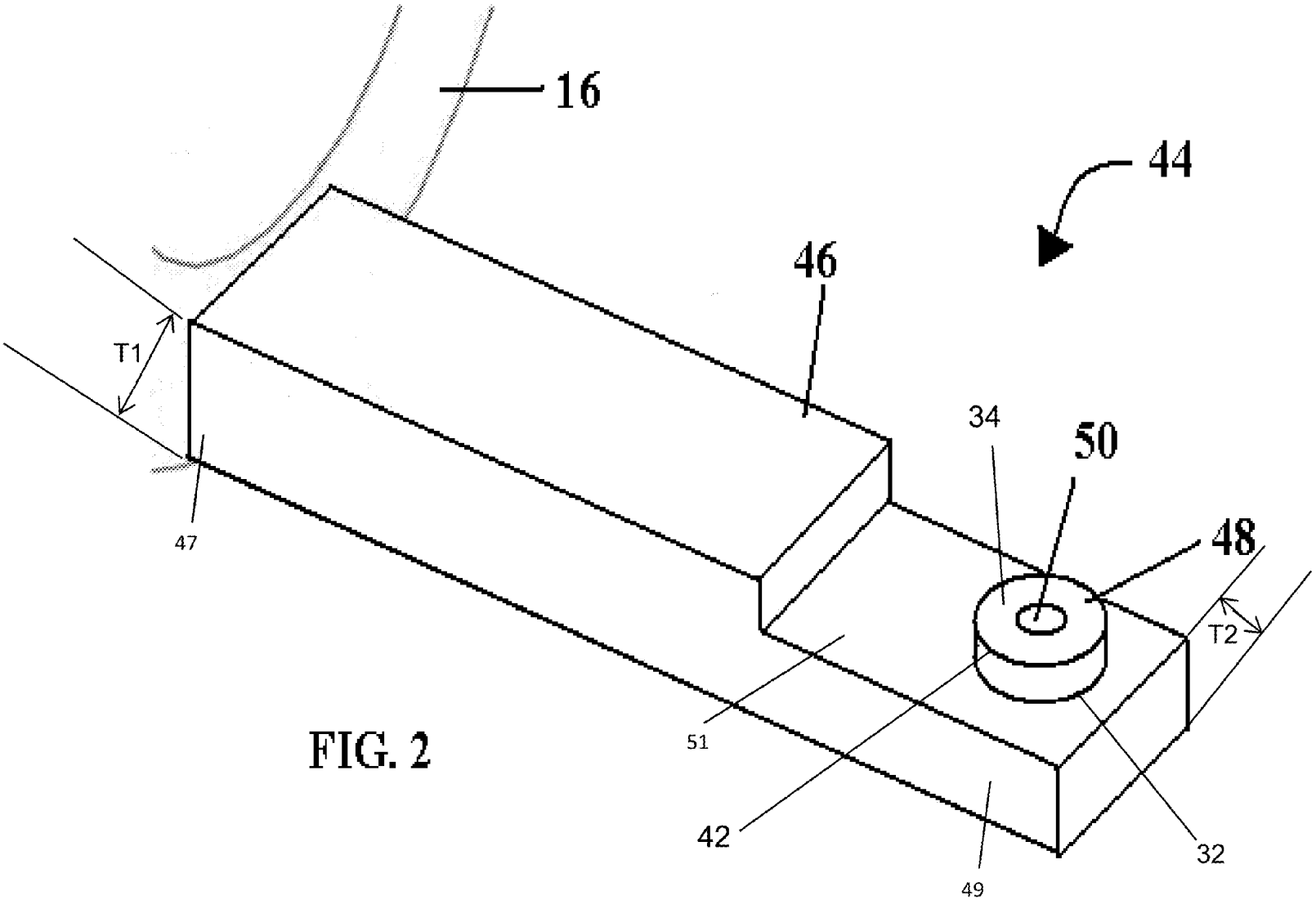
FIG. 2 is a detailed perspective view of an end of a spark plug, and showing a ground electrode coupled to the spark plug extending straight out from the spark plug.

As shown in FIG. 2, the ground electrode 44 comprises an electrode body 46, and the electrode body includes an anchored end 47 and a non-anchored end 49. The ground electrode 44 is attached to the outer shell 16 at its anchored end 47. The electrode body 46 is shaped in such a way as to allow attachment of the plateau 48 to the electrode body 46 with an exposed periphery around the plateau 48 while still providing for appropriate spacing between a noble metal tip 28 attached to the plateau 48 and the noble metal tip 28 of a center electrode 12. For instance, in illustrative embodiments, prior to affixing the ground electrode 44 to the outer shell 16, a manufacturing process, such as stamping for example, may be used to remove a portion of the electrode body 46 near or adjacent to the non-anchored end 49. This manufacturing process creates an electrode body 46 having a first portion of a first thickness T1 and a second portion of a second thickness T2, as illustrated in FIG. 2. The first portion of thickness T1 is adjacent to the anchored end 47 of the ground electrode 44 and the second portion of thickness T2 is adjacent to the non-anchored end 49 of the ground electrode 44, the first thickness T1 being greater than the second thickness T2. During the manufacturing process to remove a portion of the electrode body 46, the plateau 48 may be left adjacent the non-anchored end 49, the plateau 48 being a small area of the portion of the electrode body 46 being removed that is left attached to the rest of the electrode body 46. The manufacturing process may be performed such that the entire periphery 42 of the plateau 48 is exposed and accessible for additional operations. Other means of creating a plateau 48 on the electrode body 46 are also envisioned.

In illustrative embodiments, the plateau 48 may be generally cylindrical in shape, similar to the cylindrical shape of a center electrode 12. The size of the plateau 48 will vary greatly depending on the application. For instance, the diameter of the outer periphery 42 of the plateau 48 may be in the range of 1.2 to 3 times the diameter of a noble metal tip 28 that may be attached to the plateau 48. The thickness of the plateau 48 may be in the range of 0.1 to 0.5 times the thickness of the electrode body 46.

Figure 3A:
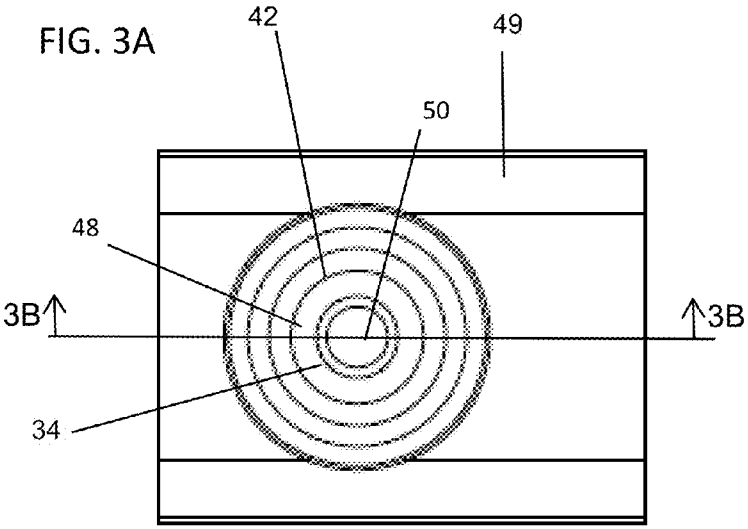
FIG. 3A is a top elevational view of a first embodiment of a ground electrode.
Figure 3B:
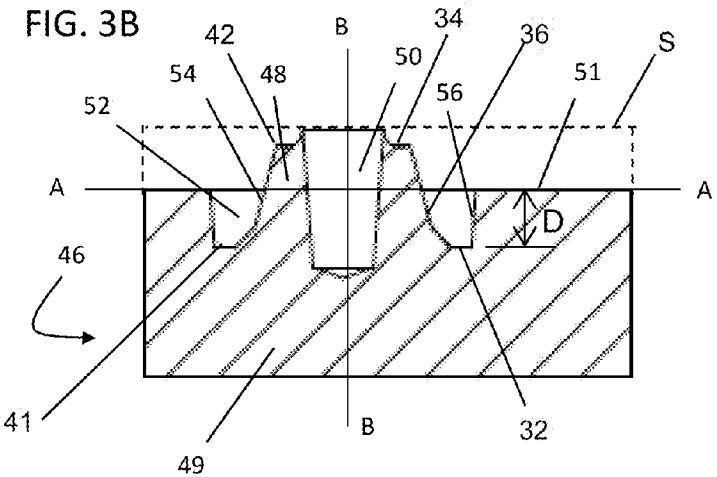
FIG. 3B is a cross-sectional view of the ground electrode of FIG. 3A taken along the lines 3B-3B.

The plateau 48 and the ground electrode 44 it is attached to may be configured in a variety of different shapes, sizes or methods, depending on the desired characteristics of the spark plug 10. In one illustrative embodiment, a bottom 32 of the plateau 48 may be coplanar with a surface 51 along which the portion of the electrode body 46 was removed adjacent the non-anchored end 49 of the ground electrode 44, as illustrated in FIG. 2. FIGS. 3A and 3B portray another illustrative embodiment of the ground electrode 44 wherein the bottom 32 of the plateau 48 may be below the surface 51 and the depth of the portion of the electrode body 46 removed from the ground electrode 44 depends of the location relative to the plateau 48. In FIG. 3B, the original surface of the electrode body 46 is illustrated by dotted line S. A portion of the electrode body 46 is removed along a plane A-A passing through a generally middle section of the plateau 48 such that a portion of the plateau 48 extends upwards beyond the exposed surface 51. Adjacent the plateau 48, an additional depth D of the electrode body 46 is removed radially around the periphery of plateau 48 such that a gap 52 is formed along plane A-A between the plateau 48 and the surface 51 of the electrode body 46.

Figure 4A:
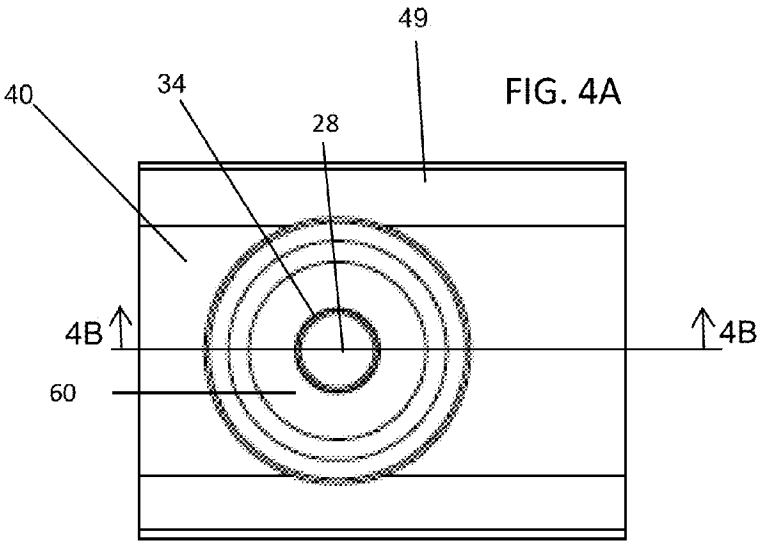
FIG. 4A is a top elevational view of a further embodiment of a ground electrode and showing a noble metal tip attached to the ground electrode.
Figure 4B:
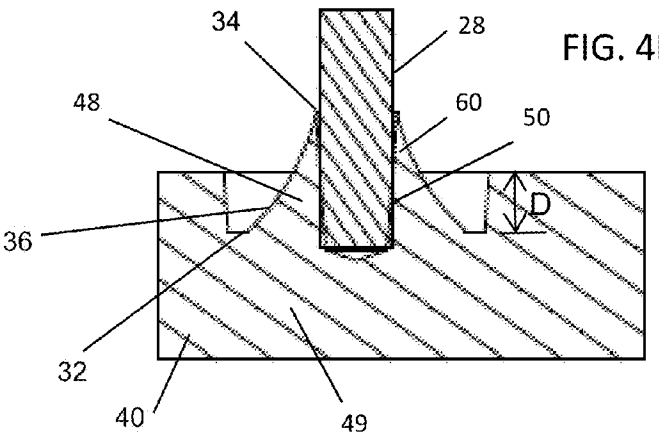
FIG. 4B is a cross-sectional view of the ground electrode of FIG. 4A taken along the lines 4B-4B.

In another exemplary embodiment, the positioning and contour of the gap 52 is arranged symmetrically across a central axis B of the plateau 48. However, the contour of the gap 52 itself need not be symmetrical. For example, a base 41 of the gap 52 adjacent the bottom 32 of the plateau 48 may be flat, as illustrated in FIG. 3B. An outer perimeter 56 of gap 52 may be vertical or may be angled conically in a direction away from the plateau 48. An inner perimeter 54 of the gap 52 defined by a side wall 36 of the plateau 48 may include a plurality of vertical or angled portions having varying lengths and degrees of steepness. In one illustrative embodiment, the side wall 36 and inner perimeter 54 may be angled in a direction toward the center of plateau 48 to form the generally frustoconical shaped gap 52, as illustrated in FIGS. 4A-4B.

As discussed, the noble metal tip 28 may be affixed to a top surface 34 of the plateau 48 by a process of welding or applying laser beams to the plateau 48 and/or noble metal tip 28. For example, to affix the noble metal tip 28 in place, it may be held against the plateau 48 to be laser brazed with a laser beam, or alternatively the noble metal tip 28 may first be resistance welded and then laser brazed with a laser beam. By affixing the noble metal tip 28 to the top surface 34 of the cylindrical plateau 48, the generally cylindrical shape of the plateau 48 makes it possible for the melted material of the plateau 48 to flow around the noble metal tip 28 similar to a braze, in a sufficient manner to form a secure connection without cracks. This is similar to how, as known in the industry, the generally cylindrical shape of the center electrode 12 makes it possible for the melted material of the center electrode 12 to flow around the noble metal tip 28 sufficient to form a secure connection without cracks.

Attachment of the noble metal tip 28 to the plateau 48 may be performed by a variety of attachment methods. As illustrated in FIGS. 2-5B, the plateau 48 may include a hole 50 centered along the central axis B to receive the noble metal tip 28. The hole 50 extends into the plateau 48 of the electrode body 46 to a depth at least equal to the depth D of the gap 52 or the depth of the plateau 48. The noble metal tip 28 may be located within the hole 50, as illustrated in FIGS. 4A and 4B. Any of a variety of methods may be used to affix the noble metal tip 28 onto the plateau 48, such as welding for example. In one illustrative embodiment, laser brazing with a laser beam may be used to couple the noble metal tip 28 to the plateau 48. In another illustrative embodiment, the noble metal tip 28 may first be resistance welded to the plateau 48 before being laser brazed with a laser beam.

In alternative illustrative embodiments, when attaching the noble metal tip 28 to the plateau 48, a melted filler material 60 (which may be similar to the material of the electrode body 46) may cover at least a portion of the noble metal tip 28 and the plateau 48 around their respective peripheries. This filler material 60 may be used to partially define the side wall 36 of the plateau 48, as illustrated in FIGS. 4A-4B. When solidified, the filler material 60 may overlap a portion of side wall 36 such that the profile of the side wall 36 becomes generally arc-shaped where the filler material 60 is located. The filler material 60 could be a variety of materials, including but not limited to, an alloy similar to the material of the plateau 48 or the noble metal tip 28. The filler material may also be a combination of one or more elements included in the plateau 48 and/or the noble metal tip 28. Still optionally, the filler material may be any other suitable filler material. The filler material 60 may extend over the side wall 36 of the plateau 48 and/or any exposed portion of the noble metal tip 28.

Figure 5A:
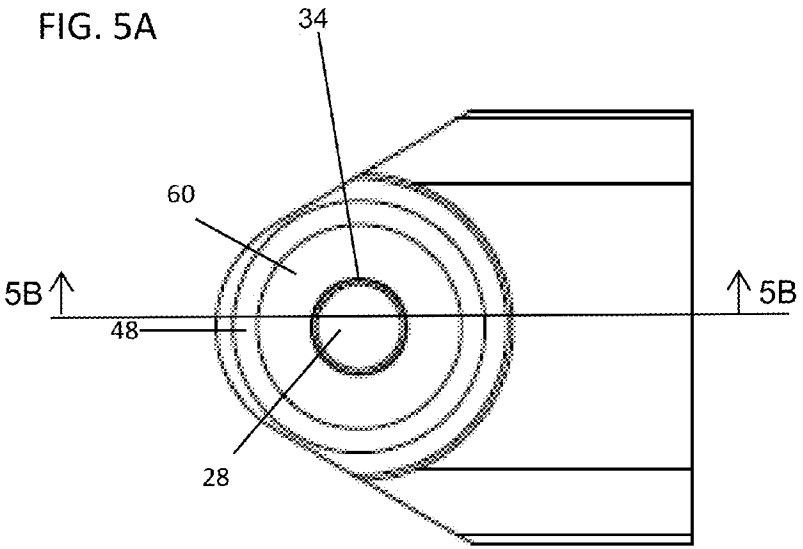
FIG. 5A is a top elevational view of another embodiment of a ground electrode and showing a portion of the ground electrode removed.
Figure 5C:
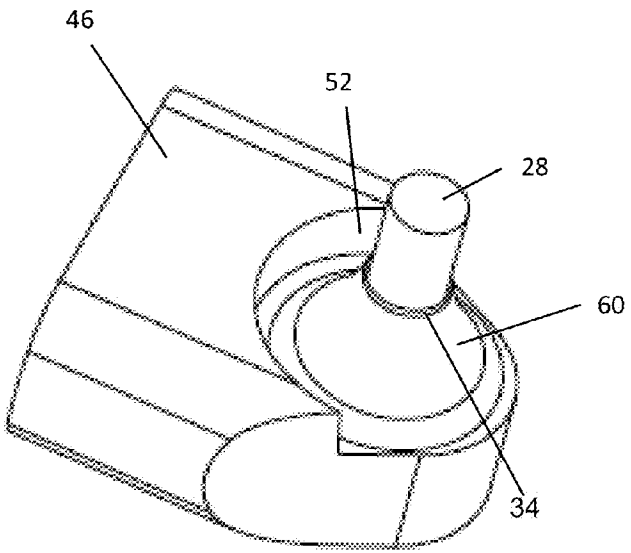
FIG. 5C is a top and side perspective view of the ground electrode of FIG. 5A.
Figure 5B:
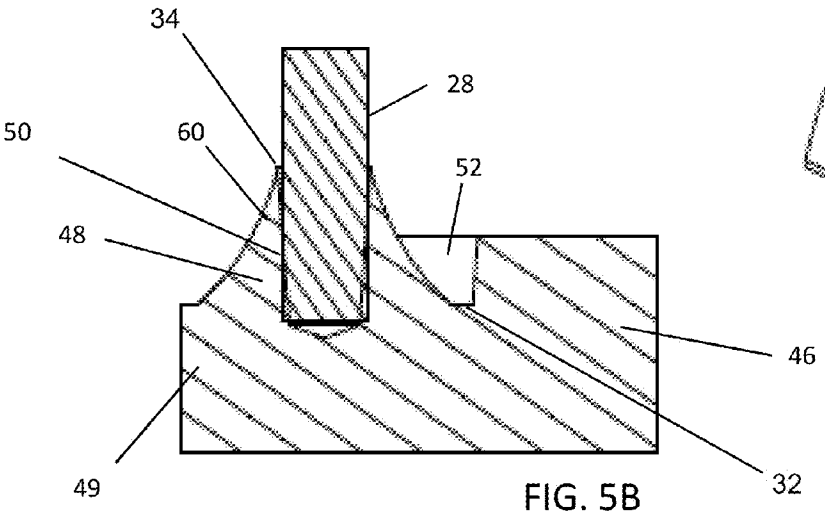
FIG. 5B is a cross-sectional view of the ground electrode of FIG. 5A taken along the lines 5B-5B.

As illustrated in FIG. 4A, after connecting the noble metal tip 28 to the plateau 48, a portion 40 of the non-anchored end 49 of the ground electrode 44 remains such that the plateau 48 is located between the portion 40 and the anchored end 47. In alternative embodiments, the portion 40 of the non-anchored end 49 may be separated from the plateau 48 by gap 52, as illustrated in FIGS. 5A-5C. During a subsequent manufacturing process, the portion 40 may be removed from the ground electrode 44. The portion 40 may be removed around the contour of the plateau 48 along the non-anchored end 49, so that removal of the portion 40 does not impact the joint between the noble metal tip 28 and the plateau 48. Similarly, additional material not affecting the joint between the tip 28 and the plateau 48 may be removed from the sides of the plateau 48 at an angle in the direction of the non-anchored end 49. Removal of the portion 40 may provide additional clearance around the periphery of the plateau 48 and, subsequently, the noble metal tip 28 of the ground electrode 44 for efficient spark production.

Figure 6A:
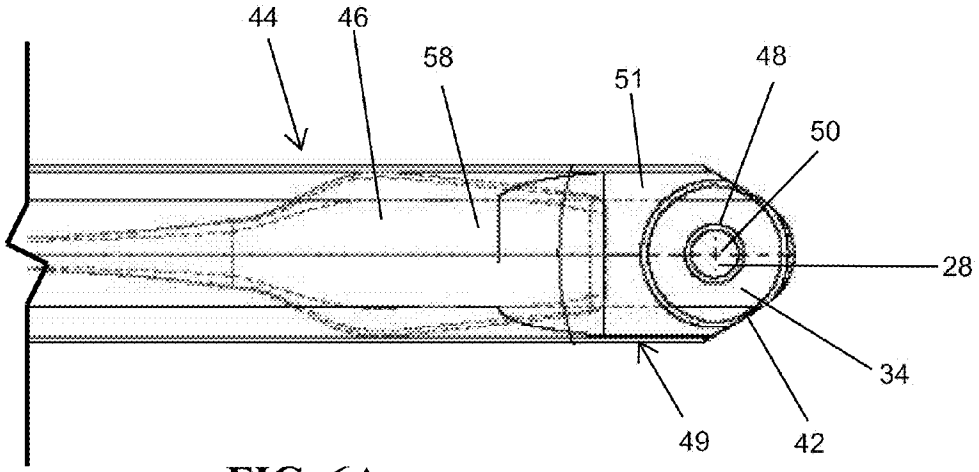
FIG. 6A is a top elevational view of another embodiment of a ground electrode.
Figure 6B:
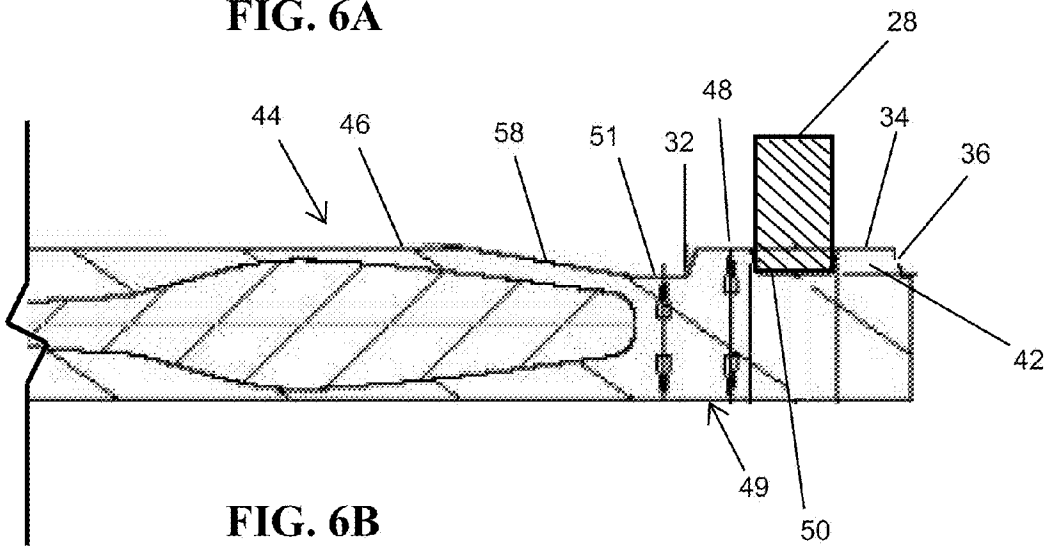
FIG. 6B is a cross-sectional side view of the ground electrode of FIG. 6A, showing a body of the electrode tapers toward a noble metal tip.

FIGS. 6A-6B illustrate another alternative embodiment of the ground electrode 44. Similar to FIGS. 5A-5C, the portion 40 and additional material may be removed from the non-anchored end 49 to make the non-anchored end 49 rounded in shape. A tapered portion 58 extends for at least a portion of the electrode body 46 of the ground electrode 44, tapering toward the surface 51 along which the portion of the electrode body 46 was removed adjacent the non-anchored end 49, as illustrated in FIG. 2. The plateau 48 extends from the surface 51 adjacent a bottom of the tapered portion 58. The noble metal tip 28 extends into the hole 50 of the plateau 48. The tapered portion 58 of this embodiment may provide additional manufacturing efficiencies for the ground electrode 44. Further, providing a smooth, tapered finish down to the surface 51 of the ground electrode 44 may improve thermal management and reduce mechanical stresses on the ground electrode 44, Exemplary embodiments disclosed herein should improve the joint life between a ground electrode 44 and a corresponding noble metal tip 28. To improve the joint life, the ground electrode 44 may be modified to include a generally rounded plateau 48 on the ground electrode 44 in a region of removed material, thus adjusting the shape of the ground electrode 44 relative to the noble metal tip 28. By affixing the noble metal tip 28 to a generally rounded plateau 48 of the ground electrode 44, a durable connection may be formed between the noble metal tip 28 and the ground electrode 44. This connection is similar to the connection of a cylindrical center electrode 12 and a noble metal tip 28. The plateau 48 acts as the material of the ground electrode 44 body that melts and flows freely around the noble metal tip 28 to form a durable connection free of cracks.

While the principles of the present invention are depicted as being implemented within a particular spark plug, it is contemplated that the principles of the present invention may be implemented within various types and sizes of spark plugs.

While this invention has been described with reference to illustrative embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims and their legal equivalence.

What is claimed is:

1. A ground electrode, comprising:

a ground electrode body including an anchored end and a non-anchored end opposite the anchored end;

a plateau extending from a surface of the ground electrode body adjacent the non-anchored end, wherein the plateau is exposed about its periphery;

a cavity formed within the plateau;

a noble metal tip disposed within the cavity and fixably attached to the plateau such that an inner cylindrical wall of the plateau forming the cavity is in contact with side walls of the noble metal tip; and a gap formed around at least a portion of an outer periphery of the plateau, wherein the gap extends below an upper surface of the ground electrode body.

2. The ground electrode according to claim 1, wherein the plateau is generally cylindrical in shape.

3. The ground electrode according to claim 1, wherein an outer diameter of the plateau is in the range of approximately 1.2 to 3 times a diameter of the noble metal tip.

4. The ground electrode according to claim 1, wherein a thickness of the plateau is in the range of approximately 0.1 to 0.5 times a thickness of the ground electrode body.

5. The ground electrode according to claim 1, wherein the plateau extends above a plane of the ground electrode body.

6. The ground electrode according to claim 5, wherein the gap is symmetrical across a central axis of the plateau.

7. The ground electrode according to claim 5, wherein the plateau is a generally frustoconical shape.

8. A spark plug comprising:

an elongated center electrode;

an insulator substantially surrounding the center electrode;

an outer shell surrounding the insulator;

a ground electrode body having an anchored end attached to the outer shell and a non-anchored end spaced from the center electrode, wherein the non-anchored end is rounded and the ground electrode body includes a first portion having a first thickness and a second portion having a second thickness, wherein the first thickness is larger than the second thickness;

a plateau extending from the second portion of the ground electrode body and defining a cavity;

a tapered portion extending between the first portion and the second portion, wherein the tapered portion has a thickness that decreases between the first portion and the second portion; and a noble metal tip fixed within the cavity of the plateau such that an inner cylindrical wall of the plateau forming the cavity is in contact with side walls of the noble metal tip.

9. The spark plug according to claim 8, wherein the first portion of the ground electrode body is adjacent the anchored end and the second portion of the ground electrode body is adjacent the non-anchored end.

10. The spark plug according to claim 8, wherein the plateau is generally cylindrical in shape.

11. The spark plug according to claim 8, wherein an outer diameter of the plateau is in the range of approximately 1.2 to 3 times a diameter of the noble metal tip.

12. The spark plug according to claim 8, wherein a thickness of the plateau is in the range of approximately 0.1 to 0.5 times a thickness of the ground electrode body.

13. A method of forming a ground electrode comprising:

removing a portion of a ground electrode body near a first end to create a plateau exposed about its periphery;

affixing a noble metal tip within a cavity of the plateau, wherein an inner cylindrical wall forming the cavity of the plateau is in contact with side walls of the noble metal tip; and forming a gap between at least a portion of an outer periphery of the plateau and the ground electrode body.

14. The method of forming a spark plug according to claim 13, wherein the plateau is generally cylindrical in shape.

15. The method of forming a spark plug according to claim 13, wherein the plateau extends above a plane of the ground electrode body along which a portion of the ground electrode body was removed.

16. The method of forming a spark plug according to claim 13, wherein the noble metal tip is laser brazed to the plateau with a laser beam.

17. The method of forming a spark plug according to claim 16, wherein the noble metal tip is resistance welded before being laser brazed in position.

18. The ground electrode according to claim 1, wherein the gap is formed by a tapered portion that extends between a first portion of the ground electrode body having a first thickness and a second portion of the ground electrode body having a second thickness, wherein the first thickness is greater than the second thickness.

19. The method of forming a spark plug of claim 13, wherein the gap is formed by a tapered portion that extends between a first portion of the ground electrode body having a first thickness and a second portion of the ground electrode body having a second thickness, wherein the first thickness is greater than the second thickness.

* * * * *